US009278831B2

(12) United States Patent
Gao et al.

(10) Patent No.: US 9,278,831 B2
(45) Date of Patent: Mar. 8, 2016

(54) CONSTRUCTION APPARATUS AND METHOD FOR LIFTING AND SLIDING OBJECT OVER BARRIER IN HORIZONTAL DIRECTION

(71) Applicants: Guangzhou Construction Engineering Co., Ltd., Guangzhou (CN); Shanghai YeSheng Mechanical & Electrical Control Technology Co., LTD, Shanghai (CN)

(72) Inventors: Junyue Gao, Guangzhou (CN); Long Wang, Guangzhou (CN); Wei Wei, Shanghai (CN); Jianming Wen, Shanghai (CN); Sui Yin, Guangzhou (CN); Yanfeng Jia, Shanghai (CN); Yuantao Zhao, Shanghai (CN)

(73) Assignees: GUANGZHOU CONSTRUCTION ENGINEERING CO., LTD., Guangzhou (CN); SHANGHAI YESHENG MECHANICAL & ELECTRICAL CONTROL TECHNOLOGY CO., LTD, Shanghai (CN)

( * ) Notice: Subject to any disclaimer, the term of this patent is extended or adjusted under 35 U.S.C. 154(b) by 301 days.

(21) Appl. No.: 14/032,834

(22) Filed: Sep. 20, 2013

(65) Prior Publication Data

US 2014/0348623 A1 Nov. 27, 2014

(30) Foreign Application Priority Data

May 23, 2013 (CN) ..... 2013 1 0194901

(51) Int. Cl.

| | |
|---|---|
| ***B66C 19/00*** | (2006.01) |
| ***B66C 13/08*** | (2006.01) |
| ***B66C 13/04*** | (2006.01) |

(52) U.S. Cl.

CPC ..... *B66C 13/08* (2013.01); *B66C 13/04* (2013.01)

(58) Field of Classification Search

CPC ..... B66C 13/06; B66C 13/063; B66C 13/08; B66C 13/085

See application file for complete search history.

(56) References Cited

U.S. PATENT DOCUMENTS 3,744,652 A * 7/1973 Rieschel ..... B66C 19/007 254/89 H
3,792,779 A * 2/1974 Brazell ..... B60K 17/10 212/283

(Continued)

FOREIGN PATENT DOCUMENTS

CN 101863430 A 10/2010
CN 201649671 U 11/2010

*Primary Examiner* — Emmanuel M Marcelo

(74) *Attorney, Agent, or Firm* — Muncy, Geissler, Olds & Lowe, P.C.

(57) ABSTRACT

The present invention disclosed an apparatus and for lifting and sliding object over barrier in horizontal direction, comprising two lifting beams that placed on supporting structures and located above object to be lifted and a barrier, and a lifter installed on the lifting beam. A hydraulic push instrument kit is installed on a lifting beam to move the shoulder beam and the lifter. The lifter connects with the object through the steel strand and a triangle transfer connector having three fixed-holds. When the steel strand encounters a barrier in horizontal direction, setting another lifting apparatus on the part of lifting beams located on the other side of the barrier, connecting another lifting apparatus with the third fixed-hold of transfer connectors 4 by steel strands, and lifting the object until whole load of the object has been transferred onto the second lifter and the object can move to the desired position.

9 Claims, 10 Drawing Sheets

(56) References Cited

U.S. PATENT DOCUMENTS 4,218,158 A * 8/1980 Tesson ..... F16L 1/26 405/158
4,749,328 A * 6/1988 Lanigan, Jr. ..... B66C 1/223 212/326
4,915,576 A * 4/1990 Lanigan, Jr. ..... B66C 1/663 414/459
5,765,965 A * 6/1998 Carter, Jr. ..... E02D 19/16 37/344
5,893,471 A * 4/1999 Zakula ..... B66C 13/08 212/316
2002/0194722 A1* 12/2002 Galloway ..... B23P 6/00 29/564
2006/0219525 A1* 10/2006 Dohi ..... B62D 65/18 198/685
2009/0304480 A1* 12/2009 Rosenberg ..... B63C 15/00 414/281
2010/0025349 A1* 2/2010 Khoshnevis ..... B05B 13/04 212/324
2011/0094987 A1* 4/2011 Botwright ..... B66C 1/108 212/274
2013/0167410 A1* 7/2013 Langdon ..... E02F 3/58 37/195
2014/0223661 A1* 8/2014 Galloway ..... A61G 7/1042 5/85.1
2015/0110581 A1* 4/2015 Wang ..... B66C 23/205 414/11

* cited by examiner

CONSTRUCTION APPARATUS AND METHOD FOR LIFTING AND SLIDING OBJECT OVER BARRIER IN HORIZONTAL DIRECTION

CROSS REFERENCE TO RELATED APPLICATIONS

This application claims priority of Application No. CN 201310194901.4 filed in China on May 23, 2013, under 35 U.S.C. §119, the entire contents of which are hereby incorporated by reference.

FIELD OF TECHNOLOGY

The present invention relates to a field about construction apparatus of civil engineering, and in particular a construction apparatus and method for lifting and sliding object over barrier in horizontal direction.

BACKGROUND OF THE INVENTION

With the development of society, and the increase of labor cost, negative influence of traditional construction model shows all the time, that is, high-altitude working has much potential risk and long construction period, whose construction quality is very hard to be guaranteed and project cost stays at a high level.

Therefore construction method of lifting integrally transforms high-altitude working into ground operation, which greatly reduces potential safety hazard, improves working environment, ensures construction quality, and realizes prefabrication and mechanization of structure installation. Also it enormously betters construction efficiency, construction quality and security of construction procedure of this kind of structure construction. It is especially important and meaningful to current structure construction under circumstance of raising labor cost and tight schedule. It has positive significance to change present construction production from labor-intensive, extensive and backward construction mode into technology-intensive, intensification and advanced construction mode.

However, existing lifting and moving construction methods are mostly performed in good condition of construction environment. There is no corresponding construction method for the situation where a barrier exists in the horizontal direction. In this case an assembly in bulk in high altitude is often adopted, but such way has following disadvantages:

(1) Large quantity of high-altitude working, high safety hazard, and difficulty to carry out the safety protection;

(2) Bad environment condition for welding as high-altitude working, which makes it hard to guarantee construction quality;

(3) Large quantity of high-altitude working, bad operational environment condition for welding as high-altitude working, which lead to an inconvenient operation and long construction period on site.

SUMMARY OF THE INVENTION

The present invention provides a construction apparatus and method for lifting and sliding object over barrier in horizontal direction, in order to alleviate technical problems of lifting and moving object when a barrier exists in horizontal direction.

With regard to the solution for the above defects, the present invention provides the following:

A construction apparatus for lifting and sliding object over barrier in horizontal direction, according to the present invention, comprises at least two lifting beams that placed on supporting structures, and located above object to be lifted and a barrier;

Shoulder beams are installed on the lifting beams, and a lifter is installed on each shoulder beam;

A push instrument kit is installed on each lifting beam to move the shoulder beam and the lifter, the first push instrument kit comprises a head connected to the shoulder beam, a push instrument body, and a base used to sustain the body;

A plurality of fixing-holes are configured at even intervals on upper surface of the lifting beam, in order to provide the push instrument kit with a counter-force when the push instrument kit works;

A through-hole is configured at the shoulder beam, where a steel strand can pass through;

The steel strand is connected with the object to be lifted by a transfer connector, and three connecting points are configured at the transfer connector;

Further, the transfer connector comprises two parallel triangle plates being at even intervals, and the fixing plates for securing the two triangle plates; the three connecting points are three via holes, and the position of three connecting points forms a triangle that corresponds to the triangle plate;

Further, lifting hangers are set between the transfer connector and the object to be lifted, as well as the steel strand and the transfer connector in order to prevent the steel strand from folding on the connecting point;

Further, the fixing-holes are bolt-holes so as to facilitate the push instrument kit moving;

Further, with the purpose of making the structure more stable, the shoulder beam is a box structure equipped with a through-hole, connecting ear-plates and the bound plates, wherein a steel strand can pass through the through-hole, and the connecting ear-plate is configured at the sides of the box structure and spread outward to connect to the push instrument kit, and a bound plate is configured at the bottom of the box structure;

Further, with the purpose of making the structure more stable, the base of the push instrument kit comprises a base body, and ear-plates spread outward from the base body that used to connect to the push instrument body; the base of the push instrument kit is "H"-shaped, and bolt-holes are configured at the base body such that the base can be fixed to the lifting beam by bolts through the fixing-holes configured on upper surface of the lifting beam, whereby a counter-force will be provided to the push instrument kit when the push instrument works;

Further, the lifting beam is double-beams are double-beams structure which are combined by two strips of "I"-shaped steel;

Further, a rotatable support is arranged between the shoulder beam and the lifter, in order to prevent the steel strand from folding while lifting the object, due to its delay relative to the move of the lifter, the rotatable support comprises spherical convex fixed to the base of the lifter, and load-bearing member fixed to the surface of the shoulder beam; the load-bearing member has a spherical concave facing to and matching with the spherical convex.

A construction method for lifting and sliding object over barrier in horizontal direction, according to the present invention, comprises the steps of:

(1) assembling the object to be lifted on the proper position of a construction site and setting lifting hangers onto the suitable positions of the object according to the construction requirements;

(2) placing lifting beams on supporting structures and above a barrier, installing shoulder beams on the lifting beams, and installing a hydraulic lifter on each shoulder beam;

(3) installing hydraulic push instrument kit on the lifting beam, wherein the head of the push instrument kit is connected to the shoulder beam, and the body of the push instrument kit is connected to the base of the push instrument kit which is fixed on the lifting beam by bolts;

(4) connecting first hydraulic lifter with the lifting hanger by means of the steel strand, and connecting the lifting hanger with the first connecting point of the transfer connector; connecting the lifting hanger set on the object with the second connecting point of the transfer connector, whereby the object can be lifted by the hydraulic lifter and reaches the desired height;

(5) hydraulic push instrument kits start to work when the object has reached the desired height, that is, pushing the shoulder beams by operating the push instrument kit, a pace of the hydraulic push instrument kit should match with the interval between two adjacent fixing-holds configured on the lifting beams. Once the push instrument kit works to push at the shoulder beam for a stroke, the bolt connecting the base of the push instrument kit with the lifting beam will be released, and the base of the push instrument kit can be moved forward to the next stroke, and be fixed on the fixing-holds thereon, and the push instrument kit works again to push at the shoulder beam. Such operation can proceed subsequently, until the steel strands encounter a barrier;

(6) setting another lifting apparatus on the part of lifting beams located on the other side of the barrier beam, the lifting apparatus comprise second shoulder beams and second lifters; connecting second lifter with the third connecting point of transfer connector by a steel strand, and lifting the object until whole load of the object has been transferred onto the second hydraulic lifter from the first lifter; and (7) taking out the hydraulic push instrument and installing it into the part of lifting beams located on the other side of the barrier, wherein the head of the push instrument kit is connected to the second shoulder beam, the base of the push instrument kit which is fixed on the second lifting beam by bolts through the bolt-holes configured at the base and the fixing-holes configured on upper surface of the lifting beam, whereby the second shoulder beam will be pushed as the foresaid step (5), until the object reaches its desired position.

Comparing with the prior art, the present invention can achieve the following advantages:

The present invention has stable structure and high automaticity, which transforms a great quantity of high-altitude working into ground operation, improves environmental condition of manual operation, reduces a potential dangerousness, shortens construction period, and ensures project quality and construction safety.

BRIEF DESCRIPTION OF THE DRAWINGS

The present invention will be further described in details hereinafter with the reference to accompanying drawings and exemplary embodiment, in which.

LIST OF REFERENCE CHARACTERS

Figure 1:
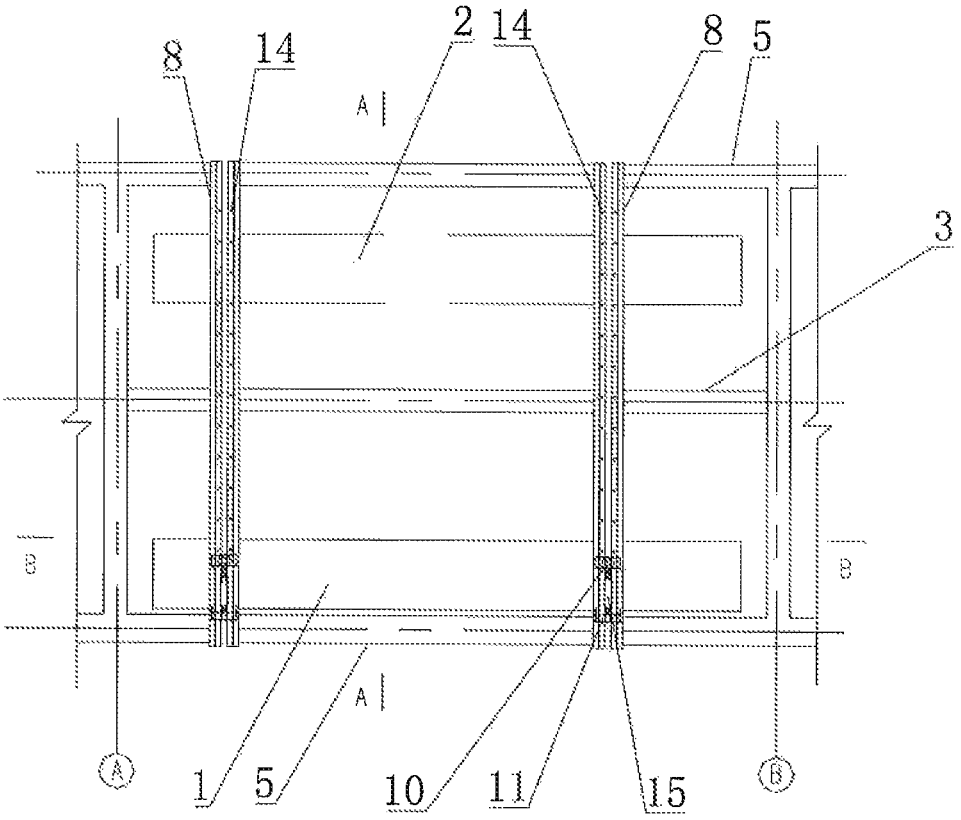
FIG. 1 is a top view according to the present invention.
Figure 2:
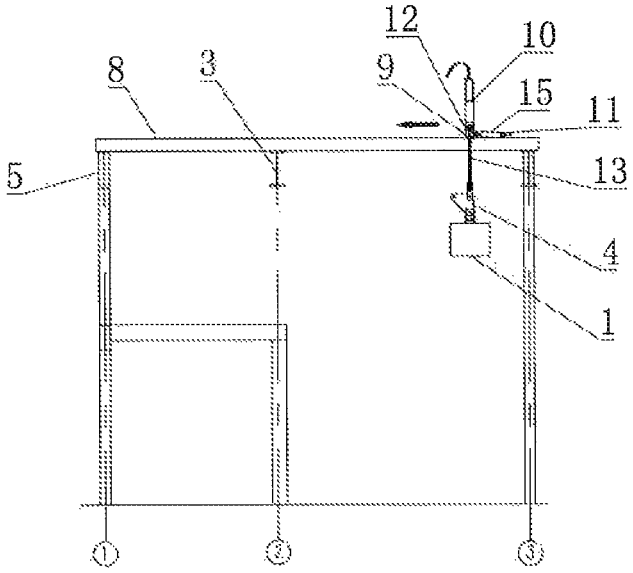
FIG. 2 is a A-A view of FIG. 1.
Figure 3:
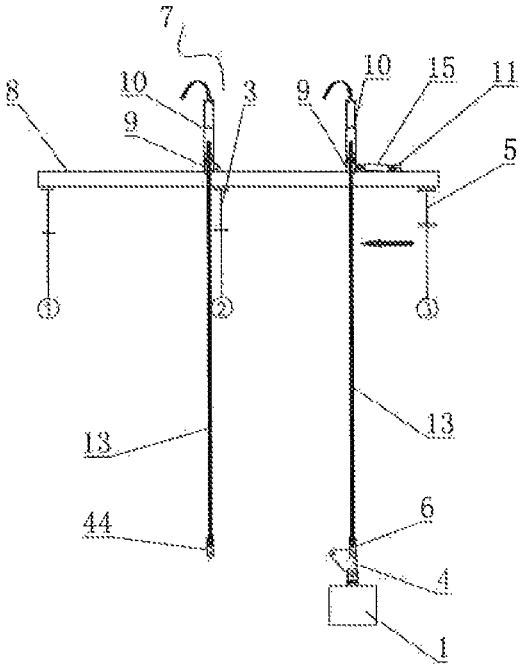
FIG. 3 is a schematic view of setting another lifting apparatus according to the present invention.
Figure 4:
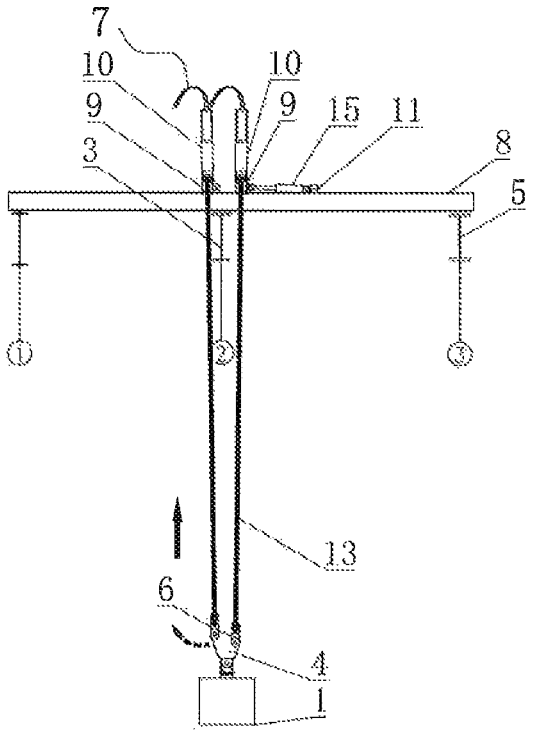
FIG. 4 is a construction schematic view during the object over the horizontal barrier, according to the present invention.
Figure 5:
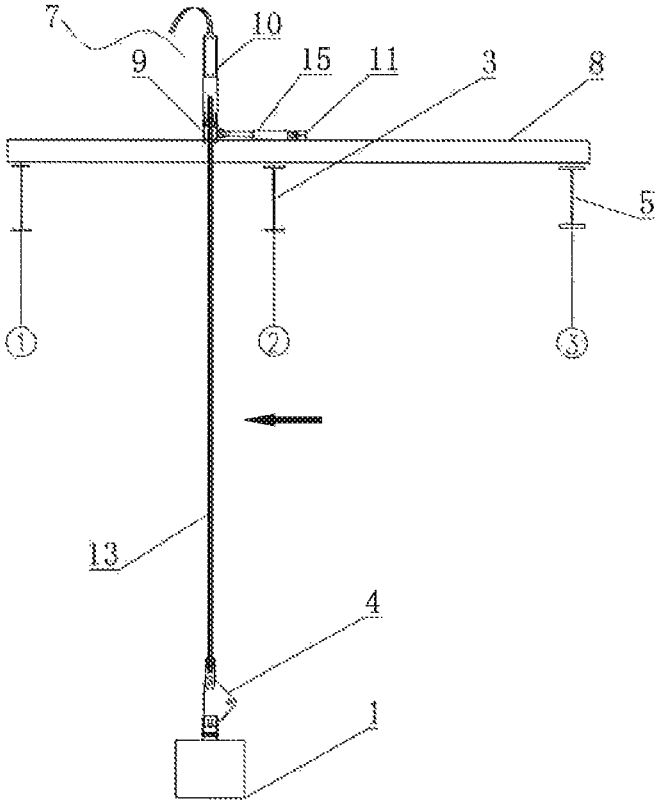
FIG. 5 is a schematic view when the whole load of the object has been transferred to another lifting apparatus, according to the present invention.
Figure 6:
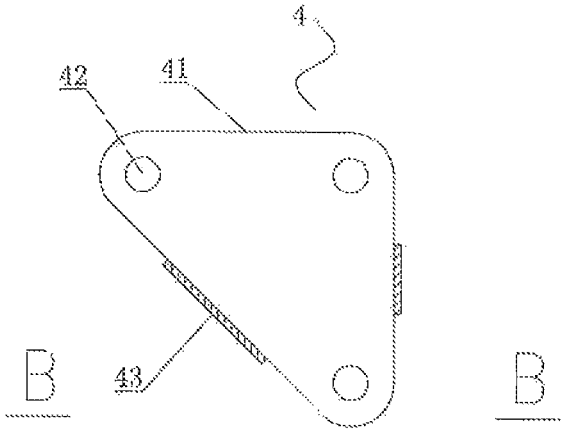
FIG. 6 is a front view of the transfer connector according to the present invention.
Figure 7:
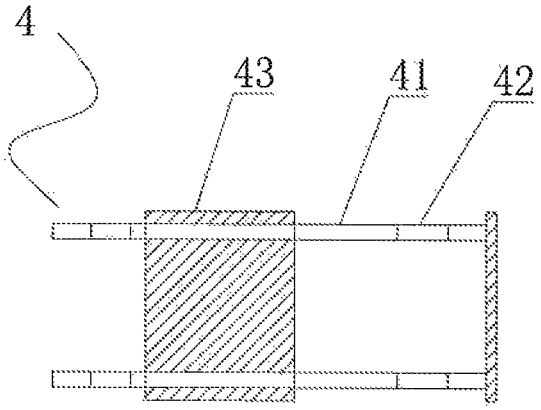
FIG. 7 is a B-B view of FIG. 6.
Figure 8:
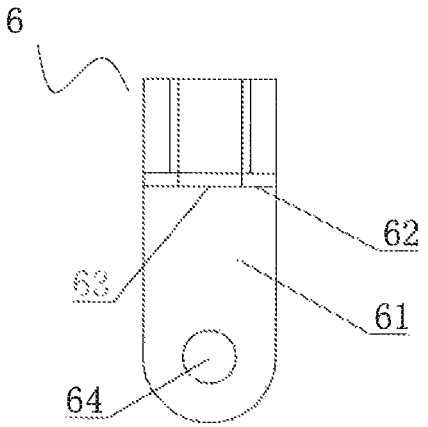
FIG. 8 is a front view of a lifting hanger according to the present invention.
Figure 9:
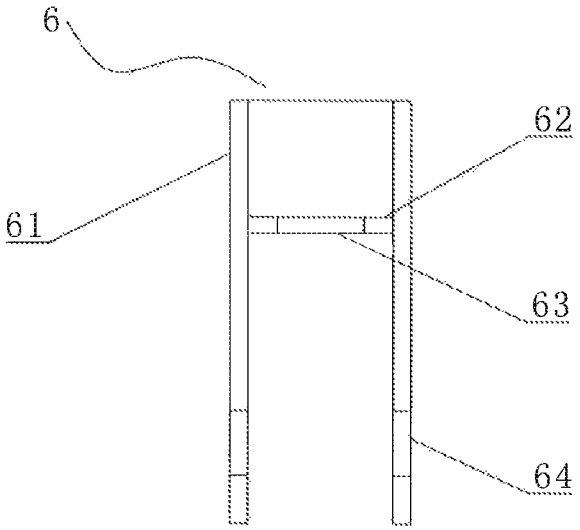
FIG. 9 is a left view of the lifting hanger according to the present invention.
Figure 10:
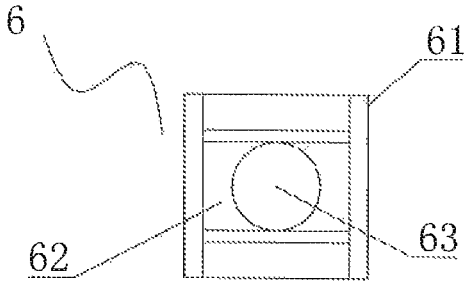
FIG. 10 is a top view of the lifting hanger according to the present invention.

1 object to be lifted
2 target position
3 barrier beam
4 transfer connector
41 transfer connector body
42 fixing-hole
43 fixing plate
5 supporting structure
6 lifting hanger
61 ear-plate
62 horizontal plate
63 mounting hole
64 holes
7 another lifting apparatus
8 lifting beam
9 shoulder beam
91 through-hole
92 connecting ear-plate
93 bound plate
10 hydraulic lifter
11 base of push instrument kit
111 base body of push instrument kit
112 bolt-hole
113 ear-plate
12 rotatable support
121 spherical convex
122 load-bearing member
13 steel strand
14 bolt-hole
15 hydraulic push instrument kit.

DETAILED EMBODIMENTS

As shown in FIGS. 1 to 7, a construction apparatus for lifting and sliding object over barrier in horizontal direction according to the present invention, comprising at least two lifting beams 8 that placed on supporting structures 5 and located above barrier 3, a push instrument kit 15, shoulder beams 9 and lifter 10 installed on each shoulder beam 9. A plurality of bolt-holes 14 are configured at interval regularly on upper surface of the lifting beam 8, the interval between two adjacent bolt-holes 14 should match with each pace of the hydraulic push instrument kit 15.

The hydraulic lifter 10 is welded onto the shoulder beam 9, the hydraulic push instrument kit 15 is installed on each lifting beam 8, the push instrument kit 15 comprises a head connected to ear-plate 92 of the shoulder beam 9, a push instrument body, and a base 11 used to sustain the body 15. The base 11 can be fixed to the lifting beam 8 by bolts through the bolt-holes 14 configured on upper surface of the lifting beam 8; the object 1 to be lifted will be lifted and moved under the action of the hydraulic lifter 10 and the hydraulic push instrument 15.

The steel strand 13 of the hydraulic lifter 10 is connected with the object 1 to be lifted by a transfer connector 4, the transfer connector comprises two parallel triangle plates 41 being at interval, and the fixing plates 43 for securing the two triangle plates; three holes 42 are configured at each triangle plate 41. When use, first hole is connected with the object 1 to be lifted, second hole is connected with the hydraulic lifter 10, and third hole will be connected with another lifting apparatus 7 when the object 1 were barred by the barrier 3 during its moving.

A lifting hanger 6 is set between the steel strand 13 and the transfer connector 4, the transfer connector 4 comprises two pieces of parallel ear-plates 61, a horizontal plate 62 that used to fix two ear-plates 61, a mounting hole 63 that used to install the steel strand 13, and a hole 64 that used to match with the hole 42 of the transfer connector 4. The lifting hanger 6 could therefore rotate around the shaft of the hole 42, whereby preventing the steel strand 13 from folding due to the object's delay relative to the move of the lifter 10.

Further, a rotatable support 12 is arranged between the shoulder beam 9 and the lifter 10, in order to prevent the steel strand 13 from folding and damaging while lifting the object, due to its delay relative to the move of the lifter 10.

The lifting beams 8 are double-beams structure which are combined by two strips of "I"-shaped steel.

Figure 11:
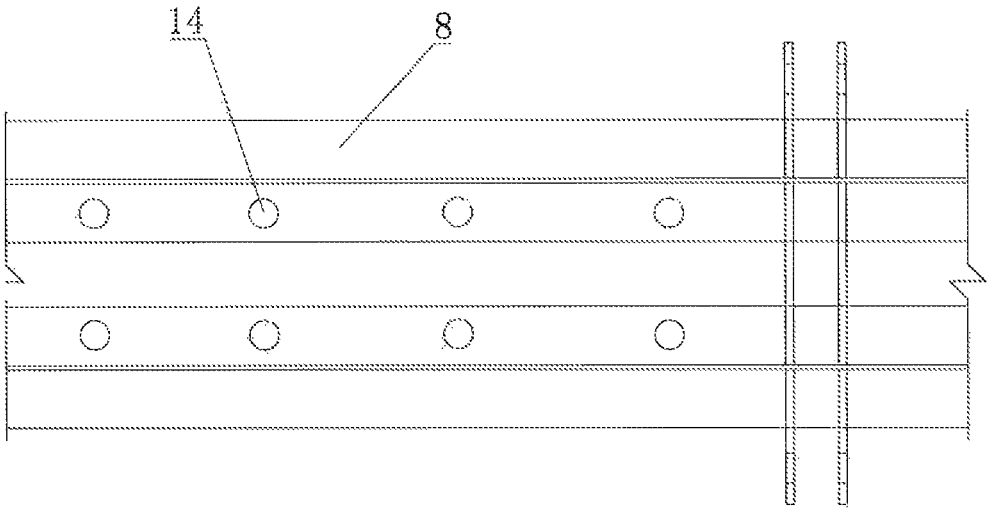
FIG. 11 is a schematic view of the lifting beam according to the present invention.
Figure 12:
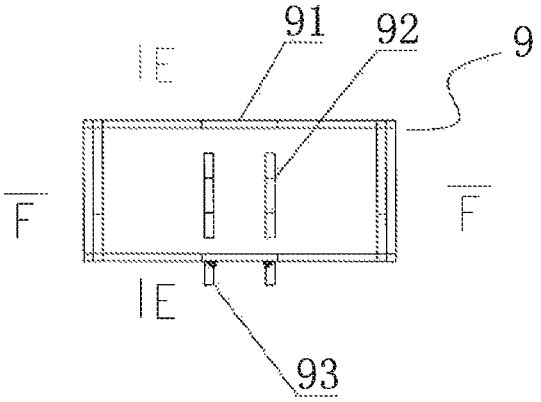
FIG. 12 is a schematic view of the shoulder beam according to the present invention.
Figure 13:
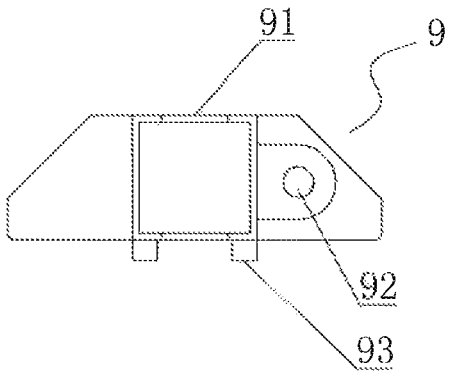
FIG. 13 is a E-E view of FIG. 12.

As shown in FIGS. 11 to 13, the shoulder beam 9 is a box structure equipped with a through-hole 91, connecting ear-plates 92 and the bound plates 93, wherein a steel strand 13 can pass through the through-hole 91, and the connecting ear-plate 92 is configured at the sides of the box structure and spread outward to connect to the push instrument kit 15, and a bound plate 93 is configured at the bottom of the box structure.

Figure 14:
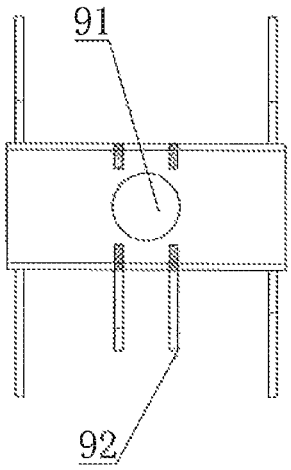
FIG. 14 is a F-F view of FIG. 12.
Figure 15:
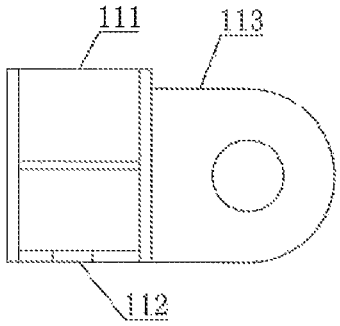
FIG. 15 is a structure schematic view of the base of push instrument kit according to the present invention.
Figure 16:
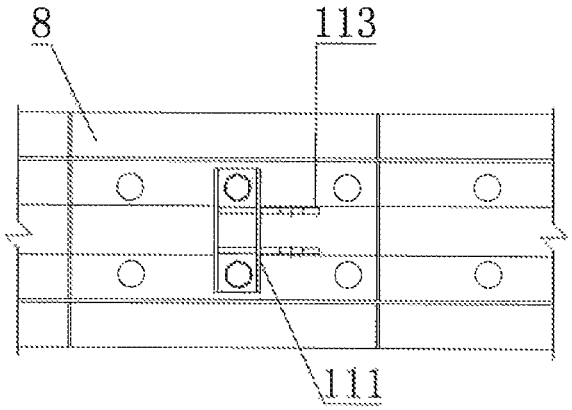
FIG. 16 is a schematic view of the base of push instrument kit in use according to the present invention.

As shown in FIGS. 14 to 15, the base 11 of the push instrument kit comprises a base body 111, and ear-plates 113 spread outward from the base body that used to connect to the push instrument body; the base body 111 of the push instrument kit is "H"-shaped, and bolt-holes 112 are configured at the base body 111 such that the base 11 can be fixed to the lifting beam 8 by bolts through the fixing-holes configured on upper surface of the lifting beam 8, whereby a counter-force will be provided to the push instrument kit 15 when the push instrument kit works.

Figure 17:
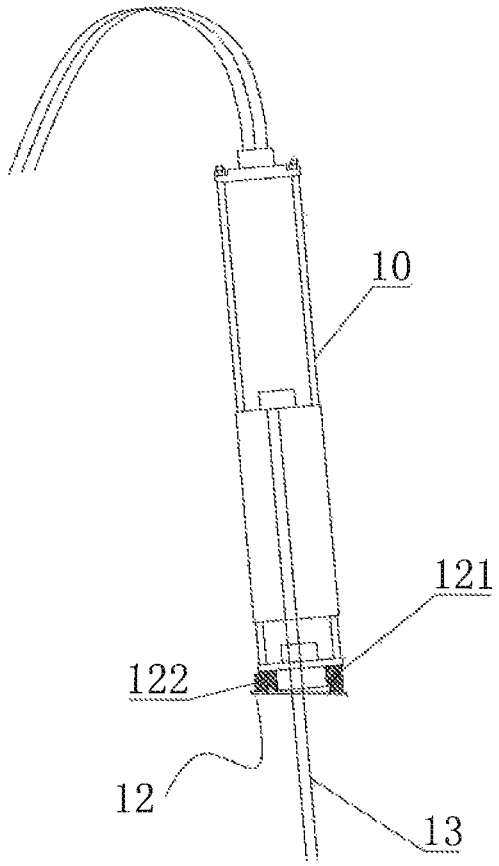
FIG. 17 is a schematic view of rotatable support between the hydraulic lifter and the shoulder beam according to the present invention.

As shown in FIG. 17, the rotatable support 12 comprises spherical convex 121 fixed to the base of the lifter 10, and load-bearing member 122 fixed to the surface of the shoulder beam 9; the load-bearing member 122 has a spherical concave facing to and matching with the spherical convex 121. When lifting the object 1, the object 1 will delay relative to the move of the lifter 10, the steel strand 13 will fold slightly. Under the action of the steel strand 13, spherical convex 121 will rotate freely in the spherical concave, which prevents the steel strand 13 from folding and damaging.

A construction method for lifting object over barrier in horizontal direction, according to the present invention, comprises the steps of (1) assembling the object 1 to be lifted on the proper position of a construction site and setting lifting hangers 6 onto the suitable positions of the object 1 according to the construction requirements;

(2) placing lifting beams 8 on supporting structures 5 and above a barrier beam 3, installing shoulder beams 9 on the lifting beams 8, and installing a hydraulic lifter 10 on each shoulder beam 9;

(3) installing hydraulic push instrument kit 15 on each lifting beam 8, wherein the head of the push instrument kit 15 is connected to the shoulder beam 9, and the body of the push instrument kit 15 is connected to the base 11 of the push instrument kit 15 which is fixed on the bolt-holes 14 of the lifting beam 8 by bolts;

(4) connecting first hydraulic lifter 10 with the lifting hanger 6 by means of the steel strand 13, and connecting the lifting hanger 6 with the first fixed-hold 42 of the transfer connector 4; connecting the lifting hanger 6 set on the object 1 with the second fixed-hole 42 of the transfer connector 4, whereby the object 1 can be lifted by the hydraulic lifter 10 and reaches the desired height;

(5) hydraulic push instrument kits 15 start to work when the object 1 has reached the desired height, that is, pushing the shoulder beams 9 by operating the push instrument kits 15, a pace of the hydraulic push instrument kit 15 should match with the interval between two adjacent bolt-holes 14 configured on the lifting beams 8. Once the push instrument kit 15 works to push at the shoulder beam 9 for a stroke, the bolts connecting the base 11 of the push instrument kit 15 with the lifting beam 8 will be released, and the base 11 of the push instrument kit 15 can be moved forward to the next stroke, and be fixed on the fixing-holds thereon, and the push instrument kit 15 works again to push at the shoulder beam 9. Such operation can proceed subsequently, until the steel strand 13 encounters a barrier beam 3;

(6) setting another lifting apparatus 7 on the part of lifting beams 8 located on the other side of the barrier beam 3, the lifting apparatus 7 comprise second shoulder beams 9 and second lifters 10; connecting second lifters 10 with the third fixed-hole 42 of transfer connectors 4 by steel strands 13, and lifting the object 1 until whole load of the object 1 has been transferred onto the second hydraulic lifter 10 from the first lifter 10; and (7) taking out the hydraulic push instrument 15 and installing it into the part of lifting beams 8 located on the other side of the barrier beam 3, wherein the head of the push instrument kit 15 is connected to the second shoulder beam 9, the base 11 of the push instrument kit 15 which is fixed on the second lifting beam 9 by bolts through the bolt-holes 112 configured at the base and the bolt-holes 14 configured on upper surface of the lifting beam 8, whereby the second shoulder beam 9 will be pushed as in the foresaid step (5), until the object 1 reaches its desired position.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A construction apparatus for lifting and sliding an object over a barrier in a horizontal direction, comprising at least two lifting beams that are placed on supporting structures, and located above the object to be lifted and the barrier, wherein shoulder beams are installed on the lifting beams, and a lifter is installed on each shoulder beam;

a push instrument kit is installed on each lifting beam to move each shoulder beam and lifter, the push instrument kit comprises a head connected to at least one of the shoulder beams, a push instrument body, and a base used to support the body;

a through hole is configured at the shoulder beam, where a steel strand can pass through;

a plurality of fixing-holes are configured at even intervals on an upper surface of each lifting beam, in order to provide the push instrument kit with a counter-force when the push instrument kit moves each shoulder beam;

the steel strand is connected with the object to be lifted by a transfer connector, and three connecting points are configured at the transfer connector.

2. The construction apparatus of claim 1, wherein the transfer connector comprises two parallel triangle plates being at even intervals, and fixing plates for securing the two triangle plates; the three connecting points are three through holes, and the position of the three connecting points forms a triangle that corresponds to the two parallel triangle plates.

3. The construction apparatus of claim 1, wherein lifting hangers are set between the transfer connector and the object to be lifted, as well as the steel strand and the transfer connector.

4. The construction apparatus of claim 1, wherein the fixing-holes are bolt-holes.

5. The construction apparatus of claim 1, wherein the shoulder beams are a box structure equipped with a through hole, connecting ear-plates and bound plates, wherein a steel strand can pass through the through hole, and the connecting ear-plates are configured at the sides of the box structure and extend outward to connect to the push instrument kit, and a bound plate is configured at the bottom of the box structure.

6. The construction apparatus of claim 1, wherein a base of the push instrument kit comprises a base body, and ear-plates extend outward from the base body for connecting to the push instrument body; the base of the push instrument kit is "H"-shaped, and bolt-holes are configured at the base body such that the base can be fixed to the lifting beams by bolts through the fixing-holes configured on an upper surface of the lifting beams, whereby a counter-force will be provided to the push instrument kit when the push instrument kit moves each shoulder beam.

7. The construction apparatus of claim 1, wherein the lifting beams are double-beams structure which are combined by two strips of "I"-shaped steel.

8. The construction apparatus of claim 1, wherein a rotatable support is arranged between the shoulder beams and the lifter, in order to prevent the steel strand from folding while lifting the object, due to its delay relative to the move of the lifter, the rotatable support comprises spherical convex fixed to a base of the lifter, and a load-bearing member fixed to the surface of the shoulder beams; the load-bearing member has a spherical concave facing to and matching with the spherical convex.

9. A construction method of using the apparatus of claim 1, comprising the steps of:

(1) assembling the object to be lifted on a proper position of a construction site and setting lifting hangers onto the suitable positions of the object according to construction requirements;

(2) placing the lifting beams on the supporting structures and above the barrier, installing the shoulder beams on the lifting beams, and installing a lifter on each shoulder beam, wherein each lifter is a hydraulic lifter;

(3) installing the push instrument kit, wherein the push instrument kit is a hydraulic push instrument kit, on at least one of the lifting beams, wherein the head of the hydraulic push instrument kit is connected to the shoulder beams, and the body of the hydraulic push instrument kit is connected to the base of the hydraulic push instrument kit which is fixed on the lifting beams by bolts;

(4) connecting a first one of the hydraulic lifters with the lifting hangers by means of the steel strand, and connecting the lifting hangers with a first one of the three connecting points of the transfer connector; connecting the lifting hanger set on the object with the second connecting point of the transfer connector, whereby the object can be lifted by the hydraulic lifters and reaches a desired height;

(5) the hydraulic push instrument kits start to move each shoulder beam when the object has reached the desired height, that is, pushing the shoulder beams by operating the hydraulic push instrument kit, a pace of the hydraulic push instrument kit should match with the interval between two adjacent fixing-holds configured on the lifting beams; once the push instrument kit works to push at the shoulder beam for a stroke, a bolt connecting the base of the push instrument kit with the lifting beams will be released, and the base of the push instrument kit can be moved forward to allow an additional stroke, and be fixed on the fixing-holds thereon, and the push instrument kit works again to push at the shoulder beam; such operation can proceed subsequently, until the steel strand encounters a barrier;

(6) setting another lifting apparatus on the part of lifting beams located on the other side of a barrier beam, the lifting apparatus comprises second shoulder beams and second lifters; connecting the second lifter with a third one of the three connecting points of the transfer connector by a steel strand, and lifting the object until the whole load of the object has been transferred onto a second one of the hydraulic lifters from a first one of the lifters; and (7) taking out the hydraulic push instrument kit and installing it into the part of lifting beams located on the other side of the barrier, wherein the head of the push instrument kit is connected to the second shoulder beams, the base of the push instrument kit which is fixed on the second lifting beams by bolts through the bolt-holes configured at the base and the fixing-holes configured on upper surface of the lifting beam, whereby the second shoulder beams will be pushed as in the foresaid step (5), until the object reaches its desired position.

* * * * *